US010597826B2

(12) United States Patent
Augustin et al.

(10) Patent No.: US 10,597,826 B2
(45) Date of Patent: Mar. 24, 2020

(54) SLEEPER PAD

(71) Applicant: Getzner Werkstoffe Holding GmbH, Burs (AT)

(72) Inventors: Andreas Augustin, Nuziders (AT); Harald Loy, Schruns (AT); Stefan Potocan, Nenzing (AT)

(73) Assignee: Getzner Werkstoffe Holding GmbH, Bürs (AT)

( * ) Notice: Subject to any disclaimer, the term of this patent is extended or adjusted under 35 U.S.C. 154(b) by 362 days.

(21) Appl. No.: 15/524,435

(22) PCT Filed: Oct. 12, 2015

(86) PCT No.: PCT/AT2015/000132

§ 371 (c)(1),
(2) Date: May 4, 2017

(87) PCT Pub. No.: WO2016/077852

PCT Pub. Date: May 26, 2016

(65) Prior Publication Data

US 2018/0127922 A1 May 10, 2018

(30) Foreign Application Priority Data

Nov. 19, 2014 (DE) ..... 10 2014 116 905

(51) Int. Cl.
*E01B 3/46* (2006.01)

(52) U.S. Cl.
CPC ..... *E01B 3/46* (2013.01); *E01B 2204/01* (2013.01)

(58) Field of Classification Search
CPC ..... E01B 3/00; E01B 3/10; E01B 3/44; E01B 3/46
See application file for complete search history.

(56) References Cited

U.S. PATENT DOCUMENTS 3,907,200 A * 9/1975 Bernard ..... E01B 1/004 238/7
4,303,199 A * 12/1981 Eisses ..... E01B 1/001 238/2
7,278,588 B2 * 10/2007 English ..... E01B 2/003 238/382

(Continued)

FOREIGN PATENT DOCUMENTS

| | | |
|---|---|---|
| AT | 506529 | 9/2009 |
| CN | 101165272 | 9/2007 |
| CN | 101125909 | 2/2008 |

(Continued)

OTHER PUBLICATIONS

Getzner 2008 article, Reprinted from European Railway Review, "Under Sleeper Pads: Improving Track Quality while Reducing Operational Costs", 8 pgs, Issue 4, 2008.

(Continued)

*Primary Examiner* — Robert J McCarry, Jr.
(74) *Attorney, Agent, or Firm* — Volpe and Koenig, P.C.

(57) ABSTRACT

The invention relates to a sleeper pad (1) for fastening to at least one outer surface (3) of a railway sleeper (4) facing a ballast bed (2), the sleeper pad (1) including or consisting of at least one damping layer (5), wherein the damping layer (5) has an EPM index in the range from 10 to 25%, preferably in the range from 10 to 20% when carrying out a load test.

16 Claims, 3 Drawing Sheets

(56) References Cited

U.S. PATENT DOCUMENTS

| | | | | |
|---|---|---|---|---|
| 2008/0083835 | A1* | 4/2008 | Girardi | E01B 1/005 238/29 |
| 2010/0320281 | A1 | 12/2010 | Potocan et al. | |

FOREIGN PATENT DOCUMENTS

| | | |
|---|---|---|
| CN | 103774512 | 5/2014 |
| DE | 4315215 | 11/1993 |
| DE | 20215101 | 2/2003 |
| DE | 10149308 | 4/2003 |
| DE | 102006013851 | 9/2007 |
| DE | 102009038414 | 3/2011 |
| DE | 102013105883 | 12/2013 |
| EP | 0609729 | 8/1994 |
| EP | 1857590 | 11/2007 |
| EP | 2108738 | 10/2009 |
| FR | 2935399 | 3/2010 |
| FR | 3028534 | 5/2016 |
| WO | 2008122065 | 10/2008 |
| WO | 2016079261 | 5/2016 |

OTHER PUBLICATIONS

Knothe, E., Rivas Project—"Results of Laboratory Tests for Ballasted Track Mitigation Measures Under Sleeper PADS (USP) and Heavy Sleepers", Deliverable D3.7 (Part B), 76 pgs., 2013.

Getzner Factsheet, "Sleeper Pads Reduce Life Cycle Costs", 4 pgs, Jan. 2014.

Track System Supplement, "Under Sleeper Pads in Track—the UIC project", European Railway Review, vol. 19, Issue 2, 7 pages, Jan. 2013.

CEN/TC 256, Railway applications—Track—Concrete sleepers and bearers—Concrete sleepers and bearers with under sleeper pads, European Standars, 77 pages, Jan. 2013.

* cited by examiner

SLEEPER PAD

BACKGROUND

The present invention relates to a sleeper pad (or tie pad) for fastening to at least one outer surface of a railway sleeper (or tie) facing a ballast bed, wherein the sleeper pad comprises or consists of at least one damping layer.

Sleeper pads are known per se from the prior art. They serve inter alia for damping vibrations which occur when traveling over the rails which are arranged on the railway sleeper. In order to achieve this, the damping layer should have the best possible elastic properties. DE 202 15 101 U1 discloses for example a sleeper pad having an elastic plastic layer and a geotextile layer which adheres to the concrete of a concrete body of the railway sleeper. From DE 43 15 215 A1 a sleeper pad is known in which the layer of the sleeper pad enclosed by the ballast bed is a fleece material. AT 506 529 A1 discloses a sleeper pad having an elastic damping layer. With this sleeper pad, on the one hand a randomly oriented fiber layer is provided for form-locking connection between the sleeper pad and the concrete railway sleeper and on the other hand a reinforcement layer of fiber material is provided.

One problem with the elastic properties of the damping layer lies in the fact that very elastic damping layers also ensure that the ballast of the ballast layer is worn away from the area underneath the railway sleepers particularly when heavy vehicles roll over the rails and thus over the railway sleepers. As a result of this there is a considerable expense arising in having to regularly top up the ballast again under the railway sleepers.

SUMMARY

The object of the invention is to provide a sleeper pad of the type mentioned at the beginning which is particularly favorable for the ballast, thus in which the ballast of the ballast bed is held as firm as possible on the sleeper pad without having to take into account significant factors regarding the damping of vibrations.

A sleeper pad according to the invention provides here that the damping layer has an EPM index in the range from 10% to 25%, preferably in the range from 10% to 20% when carrying out a load test, wherein the load test is to be carried out on a test body formed of the damping layer with a surface area of 300 mm times 300 mm and includes the following test steps:

a) establishing at least one test point on the test body at a site of the test body against which a contour plate, comprising a number of protrusions, presses in test step c) with a maximum protrusion of one of the protrusions against the test body;

b) determining a starting thickness D0 of the test body in the unloaded state at the test point in a direction perpendicular to a surface of the test body;

c) compressing the entire previously unloaded test body within 60 seconds between a level steel plate and the contour plate wherein the test body at the test point at the end of 60 seconds is compressed to 50% of its starting thickness D0 and the contour plate presses with the maximum protrusion of the protrusion of the contour plate against the test body at the test point;

d) continuously maintaining for 12 hours the compression of the test body achieved in test step c) at the end of the 60 seconds;

e) terminating the compression and fully relaxing the test body within a relaxation interval of 5 seconds at the end of the 12 hours according to test step d);

f) measuring the momentary thickness D20 of the test body at the test point 20 minutes after the end of the relaxation interval according to test step e) in the direction perpendicular to the surface of the test body according to test step b);

g) calculating the EPM index from the starting thickness D0 and the momentary thickness D20 measured in test step f), according to the formula : 100% times (D0-D20)/D0.

In order to achieve the object mentioned above the person skilled in the art has to create a sleeper pad which actually has mutually contradicting properties. On the one hand the sleeper pad or its damping layer is to have the best possible elastic properties in order to meet the desired vibration protection as extensively as possible. On the other hand the damping layer should however also have plastic properties in order to be able to permanently hold the ballast of the ballast bed in place so that it is not removed from the region under the railway sleeper and then has to be later topped up again under the railway sleeper. It has surprisingly been shown that sleeper pads having a damping layer which has an EPM index between 10% and 25%, determined through the aforementioned load test, are particularly good in meeting these mutually contradicting requirements. Particularly good results were achieved when the EPM index lies between 10% and 20%. A damping layer which meets these values has both elastic properties which are required for the vibration protection, and also plastic properties through which the ballast of the ballast layer is held firm so that there is no or only relatively little undesired discharge of the ballast from the region underneath the railway sleeper.

In the knowledge of the invention the person skilled in the art can create suitable damping layers by combining components which are known per se. It is possible for example that the skilled artisan produces corresponding damping layers, for example in a series of tests, and then checks the respective EPM index of the damping layers thus produced using the aforementioned load tests. Various different types of starting materials can be used for producing damping layers of this kind and thus also the sleeper pad. The damping layer is in a particularly preferred manner an elastomer, preferably a plastic elastomer, or a mixture of different elastomers, preferably plastic elastomers. The elastic and plastic properties of the damping layer can be adjusted by mixing different elastomers or adding other parts in such a way that the desired EPM index according to the invention, and thus the desired elastic-plastic properties are created. It is particularly preferred if the elastomer or at least one of the elastomers has or is formed of polyurethane or rubber, preferably synthetic rubber. It can be provided for example that the damping layer comprises polyurethane and at least one sterically hindered short-chain glycol. With respect to the technical materials, suitable damping layers can be achieved for example in that in the case of by way of example polyurethane elastomers the three-dimensional cross-linking density assumes comparable values as in the case of the elastic materials, but the phase separation is deliberately destroyed. Measures for this can be for example the variation of the molecular weights of the soft phase and in addition the incorporation of sterically hindered short-chain glycols.

In addition to said EPM index, in the case of the sleeper pads according to the invention, the damping layer comprises in a particularly preferred manner a bedding modulus of 0.02 N/mm$^3$ to 0.6 N/mm$^3$, preferably of 0.05 N/mm$^3$ to 0.4 N/mm$^3$. The bedding modulus is then determined according to DIN 45673-1.

The damping layer, preferably the entire test body, has in the unloaded state, thus before carrying out the load test, preferably a thickness of 5 mm to 20 mm, preferably 7 mm to 13 mm. This thickness is a value which represents the thickness of the entire damping layer or the entire test body. It corresponds as a rule to approximately the starting thickness D0 mentioned above of the test body at the test point, but need not however be absolutely identical with this since the starting thickness D0 of the test body, as outlined above, relates solely to the test point and is as a rule measured substantially more accurately than said thickness of the damping layer.

The sleeper pad can be formed solely of the damping layer. However exemplary embodiments of the invention are equally good in which the sleeper pad has further layers in addition to the damping layer. These can serve for example both for reinforcing the damping layer and also fastening the sleeper pad to the railway sleeper. It is possible that the sleeper pad is bonded to the railway sleeper or its outer face which faces the ballast bed. Preferred configurations of the invention propose however that as known from the prior art of for example AT 506 529 A1 fiber layers are provided on an outside surface of the sleeper pad which serve to fasten the sleeper pad on the railway sleeper of concrete or of another castable and hardening material such as for example plastics. These fiber layers can be for example randomly oriented fiber layers which extend partially into the material of the sleeper pad, but which also partially protrude beyond same so that the still fluid material, e.g. concrete, of the railway sleeper can engage with form fitting connection into the randomly oriented fiber layer, so that after this material of the railway sleeper has hardened a form-fitting connection is produced. As an alternative to the randomly oriented fiber layer a flock fiber layer can also be provided on the sleeper pad which likewise can be pressed into the still fluid material of a railway sleeper in order to produce a form-fitting connection between the hardened material of the railway sleeper and the flock fiber layer or sleeper pad. The flock fiber layer can however also then be helpful if the sleeper pad is fastened by a corresponding adhesive adhesively to the outside surface of the railway sleeper facing the ballast bed.

In addition or as an alternative to the fiber layer serving for fastening, sleeper pads according to the invention can also have at least one known reinforcement layer, preferably likewise of fibers or woven fiber material. This is also known per se for example from AT 506 529 A1 and need not be explained in any further detail.

It is fundamentally pointed out that sleeper pads according to the invention can be attached to railway sleepers which can be made from various different materials, such as for example concrete or wood or even plastic. If the railway sleeper comprises a castable and hardening material such as concrete or where applicable also plastic, the methods mentioned above can be used for fastening the sleeper pad to the railway sleeper. Alternatives for fastening the sleeper pad to the railway sleeper also include adhesive bonding or other suitable fastening methods which are known per se. The latter can also be used when the railway sleeper is not made from a castable hardening material, such as for example is made from wood or solid timber.

If present the fiber layers or reinforcement layers serving for fastening on the railway sleeper are preferably fastened at the edges to the damping layer. This fastening can take place for example by adhesive bonding. It is however equally possible that these fiber and/or reinforcement layers are cast or engage with form-fitting connection in the damping layer around the edges. In the case of test bodies comprising the damping layer which are used for carrying out the load test mentioned above, these layers serving for fastening on the railway sleeper or for reinforcement are however preferably completely removed. To produce the test body they can for example be peeled off, cut off, split off or removed in other suitable ways correspondingly from the sleeper pad without thereby damaging the actual damping layer. After removing these layers the test body should still have as far as possible a thickness in the range mentioned above. The test body should be configured as far as possible in the form of a plate and have a surface area of 300 mm times 300 mm. The two surfaces of the test body which are each 300 mm times 300 mm run more expediently in planes parallel to one another.

The contour plate which is used for carrying out the aforementioned load test can be configured fundamentally differently. In each case it is preferably proposed that both the steel plate and also the contour plate when carrying out the load test completely cover said 300 mm times 300 mm surface areas of the test body. The contour plate and the flat steel pate should be so rigid that during compression of the test body they do not deform, or only deform by an insignificant extent for the test result.

It is fundamentally conceivable to use different types of contour plates with different types of molded protrusions for carrying out the load test. However a geometric ballast plate is preferred according to the norm CEN/TC 256 as the contour plate. The EPM index can be determined fundamentally when carrying out the load test at only one single test point on the test body. This should in each case as far as possible not be arranged entirely at the edge of the test body. In order to minimize the effect of undesired local anomalies in the material of the damping layer and the test body on the calculation of the EPM index, it can however also be proposed that with a load test the test steps a) to g) are carried out at several test points on the test bodies so that the EPM index of the test body and thus of the damping layer is calculated through averaging the EPM indices calculated for each test point. It is possible for example to carry out the load test at five test points simultaneously in order to form said mean value therefrom. The arithmetic mean, thus the sum of the individual values divided by the number of individual values, is expediently used as mean value for this purpose.

BRIEF DESCRIPTION OF THE DRAWINGS

Further details and features of preferred configurations of the invention as well as for carrying out the load test will now be explained with reference to the following description of the drawings. In the drawings:

FIGS. 3 and 4 show sectional views through the test body along the section line AA, wherein FIG. 3 shows the unloaded state and FIG. 4 shows the state 20 minutes after the end of the relaxation interval;

DETAILED DESCRIPTION OF THE PREFERRED EMBODIMENTS

Figure 1:
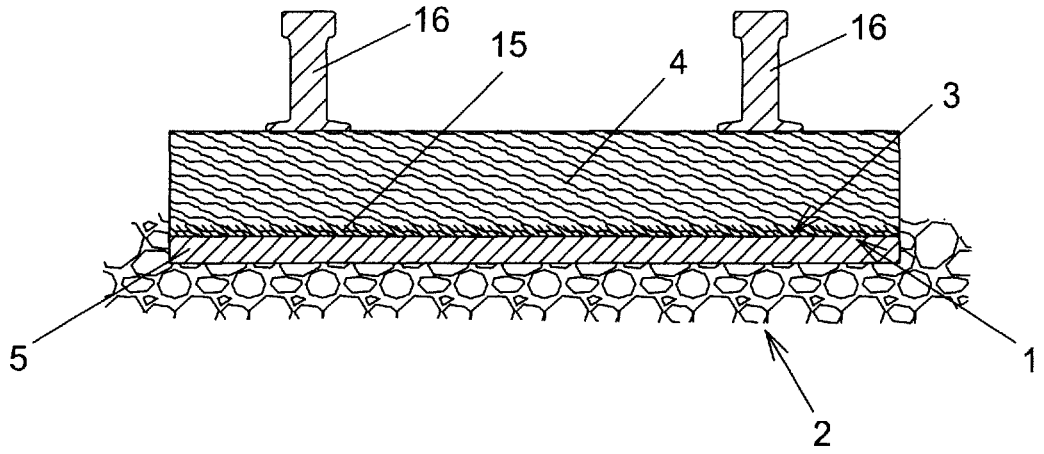
FIG. 1 shows a diagrammatic vertical section through a railway sleeper with a sleeper pad arranged underneath same on a ballast bed, wherein for completeness the rails are also shown arranged on the railway sleeper.

FIG. 1 shows the basic structure of a railway sleeper 4 which is formed in this example of concrete, with rails 16 located thereon for railway vehicles. The sleeper pad 1 is located on the outside surface 3 of the railway sleeper 4 facing the ballast bed 2. In the illustrated exemplary embodiment a fiber layer 15 is added which is fastened with form-fitting engagement preferably on both the railway sleeper 4 and also the damping layer 5. Alternatively, as already explained at the beginning, other known forms of fastening such as adhesive bonding and the like are naturally also possible. Reinforcement layers are not shown here, but they can however, as known per se in the prior art, be provided in the sleeper pad, preferably at the edges on the damping layer 5. The damping layer 5 has according to the invention an EPM index in the range from 10% to 25%, preferably in the range from 10% to 20%.

Figure 2:
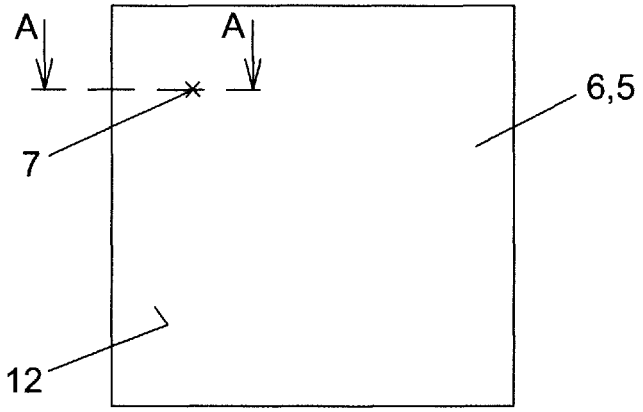
FIG. 2 shows a diagrammatic plan view of a test body.

To carry out the load test a test body 6 is made from the damping layer 5, as shown in plan view diagrammatically in FIG. 2, with surfaces each of 300 mm times 300 mm and preferably running parallel to one another. As already explained at the beginning, for this where applicable fiber layers or reinforcement layers present in the case of the concrete sleeper 1 and serving for fastening, are removed accordingly. Establishing the at least one test point 7 is carried out so that with the load test described below the contour plate 8 presses with a maximum protrusion 10 of one of its protrusions 9 against the test body 6 precisely at this test point 7.

Figure 3:
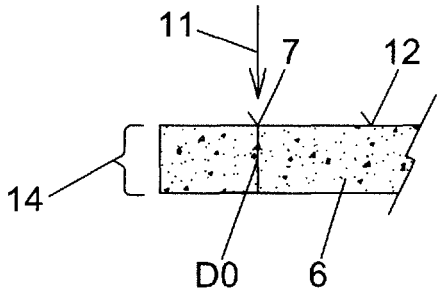
Figure 4:
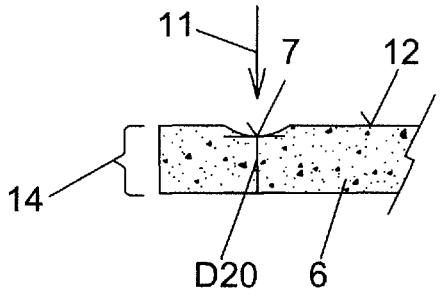

FIGS. 3 and 4 each show sections through the test body 6 along the section line AA of FIG. 2. In FIG. 3 the test body 6 is still in the unloaded state prior to the compression according to the test step c) of the load test. In this state the starting thickness D0 of the test body is measured at the test point 7 in a direction 11 normal or orthogonally to the surface 12 of the test body 6. The surface 12 of the test body 6 is then the one which is seen in plan view in FIG. 2, thus one of the two surfaces which is 300 mm times 300 mm. In the unloaded state the starting thickness D0 of the test body 6 at the test point 7 corresponds as a rule approximately to the thickness 14 which preferably has the dimensions mentioned at the beginning, and describes the thickness of the test body 6 over the entire surface area 12. The thickness 14 is a type of mean value. The thickness D0 in the test point 7 can deviate to a greater or lesser extent from the thickness 14 through local deviations or even different accurate measurements. FIG. 4 shows contrary to FIG. 3 the test body 6 in the region of the test point 7 twenty minutes after the end of the relaxation interval according to test step e). A certain residual deformation of the surface 12 can be seen in the region of the test point 7. The momentary thickness D20 of the test body 6 in the test point 7 which is also to be measured according to the test step f) is also drawn in. This measurement is to be carried out in the same direction 11 perpendicular to the surface 12 of the test body 6, as the measurement of the starting thickness D0 of the test body 6.

Figure 5:
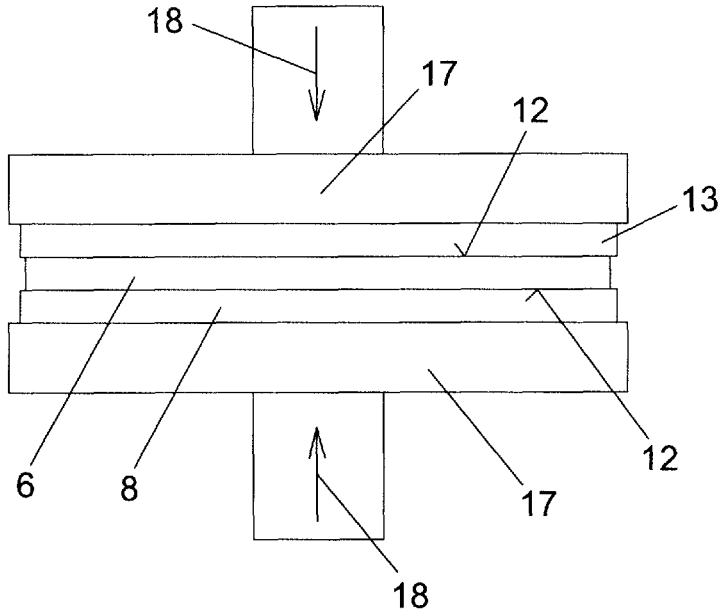
FIG. 5 shows a diagrammatic illustration of the compression of the test body.

FIG. 5 shows a diagrammatic illustration of how the compression of the entire previously unloaded test body 6 can be carried out according to the test step c) of the load test. The previously unloaded test body 6 is for this placed between a flat steel plate 13 and the contour plate 8 so that one of the surfaces 12 of the test body is facing the protrusions 9 on the contour plate 8. The opposing steel plate 13 is flat. It thus has a flat surface area on which the test body 6 bears during compression. The test body 6 bears against the flat steel plate 13 over the full surface area, thus two mutually opposing surfaces each 300 mm times 300 mm in size. The contour plate 8 more expediently covers the entire surface of that surface area 12 of the test body 6 which in this case faces the test point 7. Prior to the start of the compression the test body 6 is only bearing against the maximum protrusions 10 of the protrusions 9 of the contour plate 8. With increasing compression the protrusions 9 are pressed into the test body 6 so that the contact face between the test body 6 and the contour plate 8 increases with increasing compression. As a whole the compression of the test body in the test step c) over the entire previously unloaded test body takes place within 60 seconds. The compression is carried out until the test body 6 at the end of the 60 seconds is compressed at the test point 7 to 50% of its starting thickness D0. The contour plate 8 then presses with the maximum protrusion 10 of the protrusion 9 of the contour plate 8 against the test body 6 at the test point 7. Presses which are known per se can be used in order to carry out the compression. FIG. 5 shows diagrammatically only the pressing rams 17 of the press which are to be moved in the pressing directions 18 up to one another during compression, and which move the flat steel plate 13 and the contour plate 8 up to one another during the pressing process and support and hold them in their position in test step d). In test step d), as explained above, the compression of the test body reached in test step c) at the end of the 60 seconds is maintained continuously, thus uninterruptedly, for a period of twelve hours. At the end of these twelve hours according to test step d) the compression of the test body 6) is terminated. In the test step e) a complete relaxation of the test body 6) takes place within a relaxation interval of five seconds. In the illustrated exemplary embodiment according to FIG. 5 for this the pressing rams 17 are moved correspondingly wide apart against the pressing direction 18. The compression within the 60 seconds according to the test step c) as also the relaxation within the relaxation interval of 5 seconds according to the test step e) take place more expediently with a linear loading and relaxation slope, preferably where the pressing rams 17 are moved in the respective time intervals at constant speed up to one another, thus in the pressing direction 18, or away from one another, thus against the pressing direction 18. At the end of the loading interval according to test step e) the test body 6 is again completely relaxed. One now waits in test step f) in the once more relaxed state for 20 minutes from the end of the relaxation interval. During this twenty minutes an elastic resetting of the material of the test body 6 takes place, more particularly also at the test point 7. In order to meet according to the invention both the elastic and plastic requirements on the damping layer 5 this however involves not just a completely elastic resetting. Thus the deformation even after 20 minutes still leaves behind a certain plastic proportion so that an EPM index in the range according to the invention between 10% and 25%, preferably between 10% and 20%, is produced. If this is met then this is a sleeper pad 1 according to the invention which meets the elastic and plastic requirements according to the invention which at first glance actually contradict one another so that the sleeper pad 1 on the one hand is so elastic that it ensures the desired damping effect and thus vibration protection, but which on the other hand however is also very expedient for the ballast bed 2, since the ballast of the ballast bed 2 is held firm underneath the railway sleeper 4 through the plastic proportion of the deformation in the practical implementation by the sleeper pad 1. After measuring the thickness D20 of the test body 6 shown diagrammatically in FIG. 4 at the test point 7 at the end of said 20 minutes after the end of the relaxation interval the EPM index can be calculated in the test step g) from the starting thickness D0 and the momentary thickness D20 measured in the test step f). For this calculation the formula is used in which it is proposed that the momentary thickness D20 is subtracted from the starting thickness D0. The result of this subtraction is divided by the starting thickness D0 and the result of this division is multiplied by 100%. This produces the EPM index which according to the invention is to lie in the range from 10% to 25%, preferably in the range from 10% to 20%.

Figure 6:
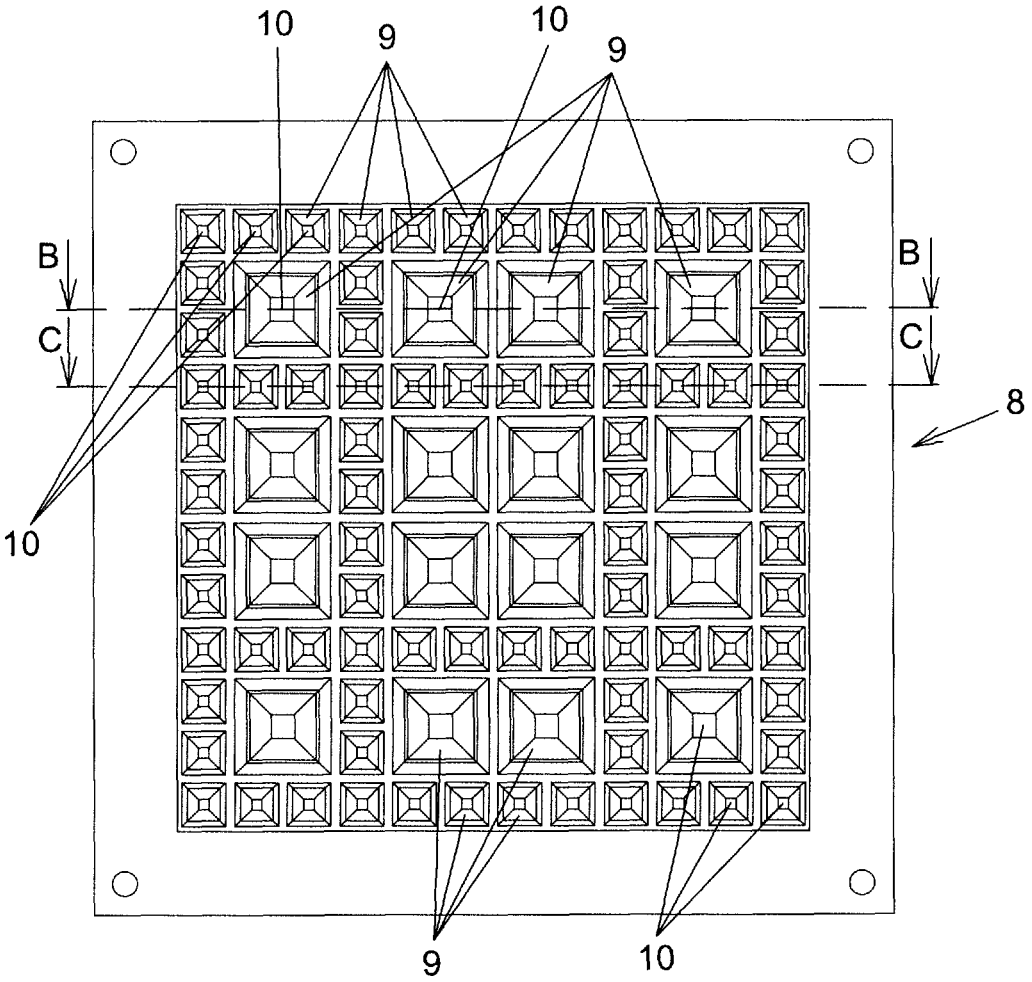
FIG. 6 shows a plan view of a preferred embodiment of a contour plate which can be used for carrying out the load test.
Figure 7:
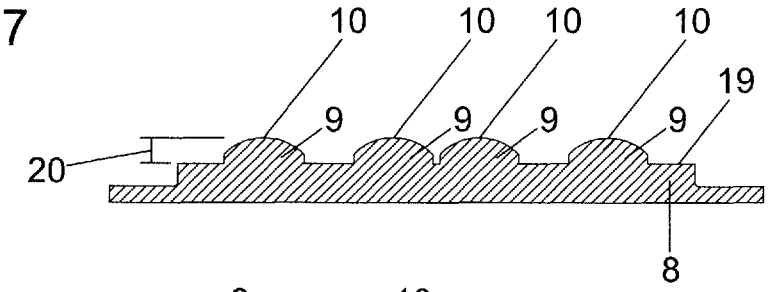
FIGS. 7 and 8 show the sections through the contour plate according to FIG. 6 along the section line B and C.
Figure 8:
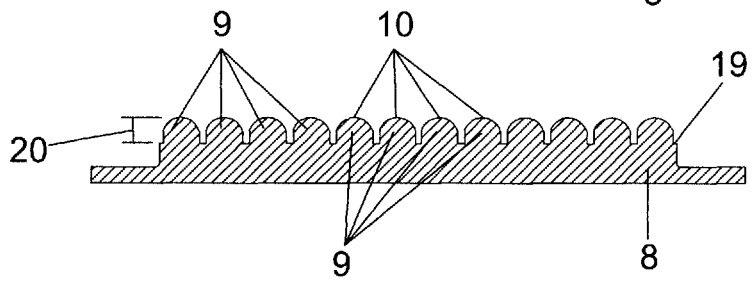

FIG. 6 shows a plan view of a contour plate 8 and its protrusions 9, preferably used when carrying out the load test, in the form of the so-called geometric ballast plate according to the norm CEN/TC 256. It can be easily seen in FIG. 6 that this contour plate 8 or geometric ballast plate according to said norm has large surface area and small surface area pyramid-like protrusions 9. The section line BB of FIG. 6 shown in FIG. 7 shows a section in the region of the large surface protrusions 9. The section along the section line CC shown in FIG. 8 shows the smaller protrusions 9 of this contour plate 8 in a sectional illustration. The protrusions 9 each protrude over a base plane 19 of the contour plate 8. The protrusions 9 have their maximum distance from this base plane 19 in the maximum protrusions 10. The maximum protrusions 10 could thus also be called a tip or peak of the protrusions 9. The test point 7 of the test body 6 bears, as said, against one of these maximum protrusions 10. Since the protrusions 9 can also have a rounded surface area, the term maximum protrusions 10 was also selected for the peak region of the respective protrusions 9. In preferred embodiments of the contour plate 8, such as the geometric ballast plate shown here, the maximum protrusions 10 of all the protrusions 9 have the same height difference 20 in relation to the base plane 19. With the geometric ballast plate according to the norm CEN/TC 256 this height different 20 amounts to 15 mm. More expediently this height difference 20 in the case of the contour plates 8 which are used for said load test, should be greater than the thickness 14 of the test body 6.

Figure 9:
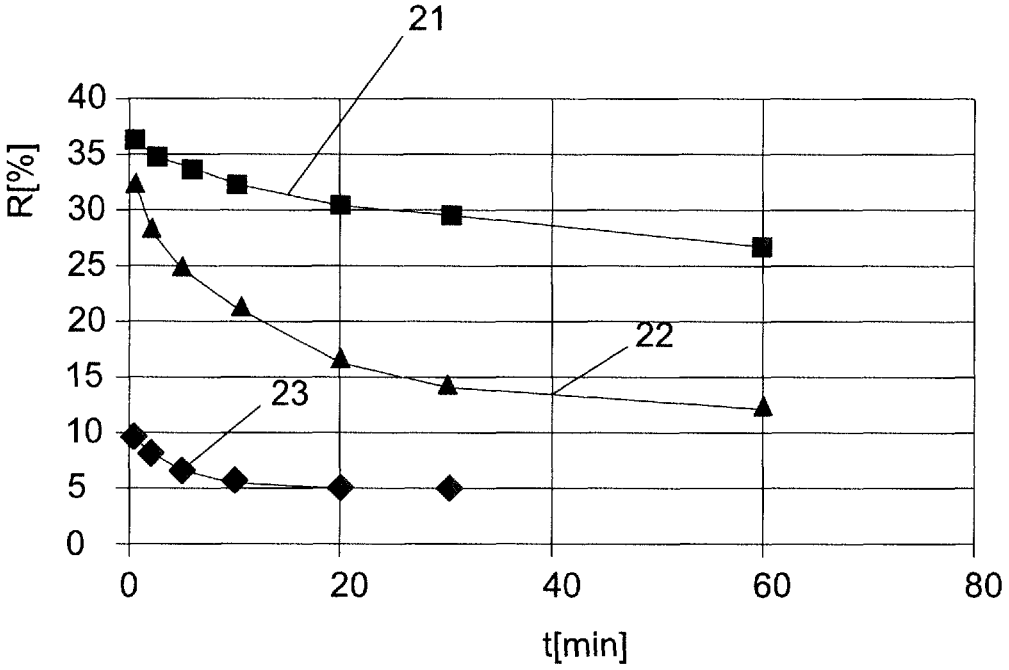
FIG. 9 shows the curves of the residual deformation R in % against the time for different materials.

FIG. 9 shows a diagram with a time interval between 0 and 80 minutes directly following the end of the relaxation interval of 5 seconds according to test step e). The curves 21, 22 and 23 are shown for the different test bodies 6. These are examples here. The curve 21 shows by way of example a test body 6 or a damping layer 5 which reacts severely plastically to the compression of the test body 6 according to test step c). Even after 60 minutes there is still a residual deformation R of 27% to be seen. Damping layers with a material of this kind are indeed very ballast-friendly, but do not achieve the desired elastic properties and thus do not achieve the desired vibration protection of the sleeper pad 1. A contrasting example of a strongly elastically pronounced behavior of a test body 6 is shown on the curve 23. Here a residual deformation of 5% does indeed remain in the form of a plastic proportion of the deformation, but this is however already reached in practice after 20 minutes. The EPM index corresponds to the residual deformation R at the time point 20 minutes. It can be clearly seen in FIG. 9 that neither the material or test body 6 with the curve 21 nor the material or test body 6 with the curve 23 has the properties of the damping layer 5 according to the invention. The illustrated curve of a test body 6 or corresponding damping layer 5 according to the invention by way of example is marked by the reference numeral 22. A residual deformation R arises twenty minutes after the end of the relaxation interval according to test step e) and thus an EPM index of about 16 to 17%, which lies somewhere in the middle in the interval according to the invention of 10 to 25%. A damping layer 5 with an EPM index of this kind has both the desired elastic properties and thus the desired vibration protection, and also the desired plastic properties and thus the desired ballast protection.

REFERENCE NUMERAL LEGEND:

1 Sleeper pad
2 Ballast bed
3 Outer surface
4 Railway sleeper
5 Damping layer
6 Test body
7 Test point
8 Contour plate
9 Protrusion
10 Maximum protrusion
11 Direction
12 Surface
13 Steel plate
14 Thickness
15 Fiber layer
16 Rail
17 Pressing ram
18 Pressing direction
19 Base plane
20 Height difference
21 Curve
22 Curve
23 Curve

The invention claimed is:

1. A sleeper pad for fastening on at least one outer surface of a railway sleeper facing a ballast bed, the sleeper pad comprising at least one damping layer having a side that is adapted to contact the ballast bed, the damping layer has an EPM index in a range from 10% to 25%, wherein the EPM index is adapted to be determined by a load test carried out on a test body formed of the damping layer with a surface area of 300 mm times 300 mm and includes the following test steps:

a) establishing at least one test point on the test body at a site of the test body against which a contour plate, comprising a number of protrusions, presses in a test step c) with a maximum protrusion of one of the protrusions against the test body;

b) determining a starting thickness D0 of the test body in an unloaded state at the test point in a direction perpendicular to a surface of the test body;

c) compressing the test body, which was entirely previously unloaded, within 60 seconds between a level steel plate and the contour plate wherein the test body at the test point at the end of 60 seconds is compressed to 50% of a starting thickness D0 thereof and the contour plate presses with the maximum protrusion of the protrusion of the contour plate against the test body at the test point;

d) continuously maintaining for 12 hours a compression of the test body achieved in test step c) at the end of the 60 seconds;

e) terminating the compression and fully relaxing the test body within a relaxation interval of 5 seconds at an end of the 12 hours according to test step d);

f) measuring a momentary thickness D20 of the test body at the test point 20 minutes after the end of the relaxation interval according to test step e) in the direction perpendicular to the surface of the test body according to test step b);

g) calculating the EPM index from the starting thickness D0 and the momentary thickness D20 measured in test step f), according to the formula: 100% times (D0-D20)/D0.

2. The sleeper pad as claimed in claim 1, wherein the damping layer has or is formed of an elastomer or a mixture of different elastomers.

3. The sleeper pad as claimed in claim 2, wherein the elastomer or at least one of the elastomers has or consists of polyurethane or rubber.

4. The sleeper pad as claimed in claim 1, wherein the damping layer comprises polyurethane and at least one sterically hindered short-chain glycol.

5. The sleeper pad as claimed in claim 1, wherein the damping layer has a ballast module of 0.02 N/mm3 to 0.6 N/mm3.

6. The sleeper pad as claimed in claim 1, wherein the damping layer has in the unloaded state prior to carrying out the load test, a thickness of 5 mm to 20 mm.

7. The sleeper pad as claimed in claim 1, wherein the contour plate comprises a geometric ballast plate having an array of small pyramid protrusions and large pyramid protrusions arranged on a surface, the small pyramid protrusions being located in rows and columns defining the edges of the array, and the large pyramid protrusions being located inside the edges according to CEN/TC 256, dated 2013-01.

8. The sleeper pad as claimed in claim 1, wherein the sleeper pad has a fiber layer fastened to the damping layer, for fastening the sleeper pad on the railway sleeper.

9. The sleeper pad as claimed in claim 1, wherein during the load test the test steps a) to g) are carried out simultaneously at several test points on the test body, and the EPM index of the damping layer is calculated by forming a mean value from the EPM indices thus calculated for each of the test points.

10. The sleeper pad as claimed in claim 1, wherein the damping layer has or is formed of a plastic elastomer or a mixture of different plastic elastomers.

11. The sleeper pad as claimed in claim 2, wherein the elastomer or at least one of the elastomers has or consists of synthetic rubber.

12. The sleeper pad as claimed in claim 1, wherein the damping layer has a ballast module of 0.05 N/mm3 to 0.4 N/mm3.

13. The sleeper pad as claimed in claim 1, wherein entire test body has in the unloaded state prior to carrying out the load test, a thickness of 5 mm to 20 mm.

14. The sleeper pad as claimed in claim 1, wherein the sleeper pad has a randomly oriented fiber layer or flock fiber layer fastened to the damping layer, for fastening the sleeper pad on the railway sleeper.

15. The sleeper pad as claimed in claim 1, wherein the sleeper pad has a reinforcement layer.

16. The sleeper pad as claimed in claim 15, wherein the reinforcement layer is formed of fibers.

* * * * *